United States Patent [19]

Inoue

[11] Patent Number: 4,711,145

[45] Date of Patent: Dec. 8, 1987

[54] RATCHET HANDLE

[76] Inventor: Isao Inoue, 11-14, Sanchiku 1-chome, Sanjo-shi, Niigata-ken, Japan

[21] Appl. No.: 897,856

[22] Filed: Aug. 19, 1986

[30] Foreign Application Priority Data

Jul. 24, 1986 [JP] Japan ..... 61-174546

[51] Int. Cl.[4] ..... B25B 23/16

[52] U.S. Cl. ..... 81/177.1; 81/177.8

[58] Field of Search ..... 81/177.8, 177.1, 177.7, 81/177.9, 489, 57.29, 58.1, 58.3

[56] References Cited

U.S. PATENT DOCUMENTS 1,039,831 10/1912 Sisson ..... 81/177.8

1,360,051 11/1920 Strang ..... 81/177.8

*Primary Examiner*—Frederick R. Schmidt

*Assistant Examiner*—Maurina Rachuba

*Attorney, Agent, or Firm*—Birch, Stewart, Kolasch & Birch

[57] ABSTRACT

A ratchet handle includes a handle that can be angularly adjusted relative to the tool carrying head. A moving part having teeth which engage teeth on the head is provided to lock the handle and head in the desired angular relationship. An arrangement is provided whereby the engaged teeth may be temporarily separated so that any desired adjustment may be made.

6 Claims, 8 Drawing Figures

A
A

RATCHET HANDLE

BACKGROUND OF THE INVENTION

The present invention relates to a ratchet handle.

In prior art devices wherein the head and the handle are integrally structured the handle is not angularly adjustable relative to the head. Thus, smooth, quick and positive utilization of the handle cannot be achieved because when an object to be turned is engaged by a tool carried by the head, slippage of any balls and pins in the head is caused, thus proper turning of the head is not provided. In addition, the handle cannot be turned with full power since there is a possibility that the operator's hand may be injured as a result of slippage from the handle.

SUMMARY OF THE INVENTION

Accordingly, it is a primary object of the present invention to provide an easy-to-use, productive ratchet handle that eliminates all of the foregoing disadvantages of the prior art ratchet handle.

It is a further object of the present invention to provide a ratchet handle wherein the handle is angularly adjustable relative to the head.

It is an additional object of the present invention to provide a construction which effecitvely locks the head and handle in any desired angular relationship.

BRIEF DESCRIPTION OF THE DRAWINGS

FIG. 1 is a perspective view of a ratchet handle embodying the present invention.

FIG. 2 is an exploded perspective view of major components of the present invention.

FIG. 3 and FIG. 4 are side views showing operating states of a ratchet handle embodying the present invention.

FIG. 5 is an enlarged fragmentary sectional view of major components of a ratchet handle embodying the present invention.

FIG. 6 is a sectional view along line A—A in FIG. 3.

FIG. 7 is a side view of another embodiment of the present invention.

FIG. 8 is an exploded, perspective view of major components in FIG. 7.

DETAILED DESCRIPTION OF THE INVENTION

Figure 1:
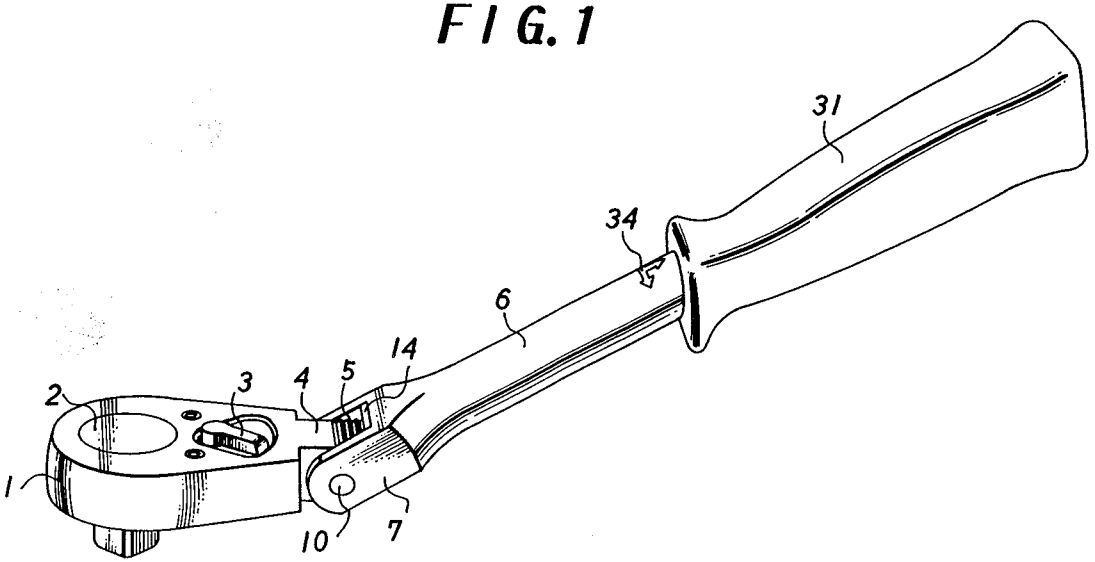
FIGS. 1 to 6 are illustrations of a preferred embodiment of the present invention.

This invention relates to a ratchet handle. In the prior art ratchet handle in which its head and handle are integrally structured, smooth, quick and positive handling of the handle cannot be achieved because when an object to be turned is engaged with an inner periphery of the head and turned with a full power in either direction, slippage of its balls and pins pressed to the inner periphery of the head is caused, causing deviation of the required turning angle, or because the handle cannot be turned with a full power with a fear that operator's hand is injured as a result of slippage from the handle.

Accordingly, it is an object of the present invention to provide an easy-to-use, productive ratchet handle that eliminates all of the foregoing disadvantages of the prior art ratchet handle.

Referring to the drawngs, the construction and operation of an ratchet handle according to the present invention will be described.

A rotating head 2 is provided at a head 1, and its rotating direction can be switched by means of a ratchet pawl 3 provided adjacent to the rotating head 2. A projection 4 is located at one end of the head 1, and teeth 5 are formed on its outer round periphery. A handle 6 is independently of the head 1, and a fork 7 is formed at its one end, one edge of said fork being provided with a through hole 8, and the other edge being provided with a threaded hole 8'. The projection 4 is placed between the fork 7; a through hole 9, and holes 8 and 8' aligned; and a threaded shaft 10 passes through the holes 9, 8 and 8'. A through hole 11 is provided longitudinally in the handle 6, and two recesses 12 are formed at upper and lower portions of one end of the handle 6. A male thread 13 is formed at one end of the through hole 11 of the handle 6, and a base 15 of a moving part 14 is inserted into the end 7 of the through hole 11 of the handle 6. Two projected teeth 16 are formed at a front center of the moving part. Tops of the projected teeth 16 is engaged with bottoms of the teeth 5 on the projection 4, and a bottom of the projected teeth 16 is engaged with a top of the teeth 5 on the projection 4. A female thread 17 is formed inside the base 15 of the moving part 14. A male thread 19 formed at one end of an operation rod 18 described later is screwed into the female thread 17. Both the teeth are of left-handed screw type to be tightened by turning counterclockwise, and loosened by turning clockwise. The operation rod 18 is inserted into the through hole 11 in the handle 6, one end of the operating rod being formed with a male thread 19, which is screwed into the female thread 17 in the moving part 14. A male thread 20 is formed around a center of the operating rod 18, which is engaged with the female thread 13 in the handle 6. Both threads are of right-handed type to be tightened by turning clockwise and loosened by turning counterclockwise.

A smoothed portion 21 is provided adjacent to the male thread 20 ont he operation rod 18. A spring 22 is mounted on the smoothed portion 21 of the operation rod 18, which is retained by a block 24 in which a female thread is formed to be engaged with a male thread 23 formed at one end of the operation rod 18. A cylinder 25, which encloses the central male thread 20 and smoothed portion 21 of the operation rod 18, is provided with upper and lower protruded portions 26 at one end thereof for engagement with the recesses 12 provided at the end of the handle 6. Upper and lower recesses 27 are provided at the other end of the cylinder 25, and flat sides 28 are formed on a circular periphery of the cylinder 25 on both sides thereof. A through hole 29 is provided vertically at the block 24 in which the male thread 23 formed at the end of the operation rod 18 is screwed horizontally. A pin 30 is inserted in the through hole 29 in such a manner that is protruded at both ends thereof. The recesses 12 of the cylinder 25 are engaged with the upper and lower protruded portions of the pin 30 so as to turn the operation rod 18. In other words, when holding a grip 31 described later and pulling it toward you, the cylinder 25 is also moved rearward and the recesses 27 at the end thereof become engaged with the protruded ends of the pin 30. As a result, when turning the grip 31 a half turn in clockwise or counterclockwise direction, the operation rod 18 is rotated via the pin 30. After turning the grip 31 a half turn, when the grip 31 is released, the cylinder 25 is moved immediately forward, the recesses 27 are disengaged fromt he pin 30, and the protruded portions 26 at the opposite end thereof are engaged with the recesses 12 of the handle 6. On the cylinder 25, the grip 31 is mounted, in which a through hole 32 is longitudinally provided, with flat faces 33 being on both sides thereof. The grip 29 is secured to the cylinder 25 with adhesive. A three-direction arrow marking 34 is provided adjacent to an edge of the grip 31 at an upper portion of the handle 6, the three-direction indicating that pulling toward you, and turning clockwise and counterclockwise.

Figure 2:
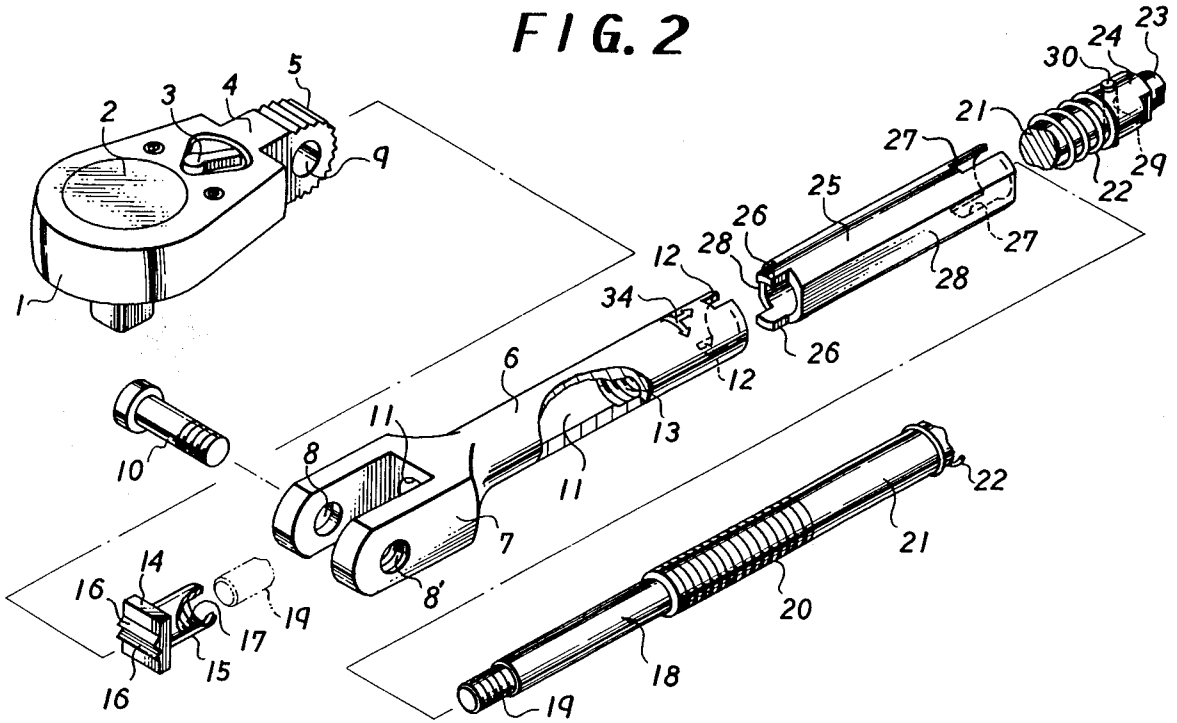

The shape of the operation rod 18 is shown in FIG. 2. Outside diameters of the male thread 19 and central male thread 20 are different: for instance, left-handed male thread 19 has 8 mm outside diameter and 1.25 mm pitch while the right-handed central male thread 20 has 12 mm outside diameter and 1.75 mm pitch. This means that when the operation rod 18 is turned one turn counterclockwise, the male thread 19 advances 1.25 mm and central male thread 20 advances 1.75 mm. Therefore, total movement of the operation rod 18 becomes 3 mm which is the sum of advancing distances of both the threads. Moreover, when the operation rod 18 is turned a quarter turn, the male thread 19 moves 0.31 mm (1.24/4 mm) and the central male thread 20 moves 0.44 mm (1.75/4 mm). Therefore, a total movement becomes 0.75 mm. This means when the operation rod 18 is turned a quarter or a half turn, not one turn, in counterclockwise direction, the operation rod 18 can move through rotation of both male threads 19 and 20 whose directions are opposite to each other, As a result, the projected teeth 16 at the moving part 14 can be disengaged from the teeth 5 formed on the projection 4 of the head 1. That is, the head 1 and the handle 6 are disengaged. In a preferred embodiment, the operation rod is designed to be turned a half turn.

After that, determine an angle between the head 1 and the handle is determined to be suitable for operation, turn the operation rod 18 is rotated a half turn clockwise for forward movement, thus engaging the projected teeth 16 at the moving part 14 with the teeth 5 at the head for locking purpose. Then, the rotating head 2 at the head 1 is engaged with an object to be turned, and then the object is turned by moving the grip 31.

Figures 3, 4:
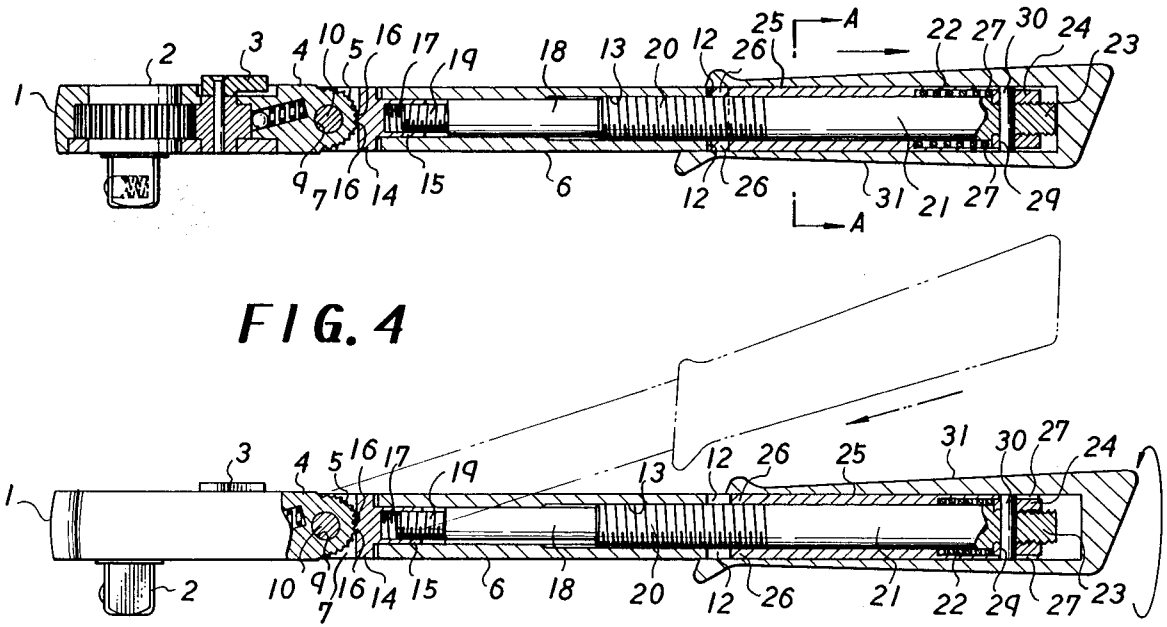
Figure 5:
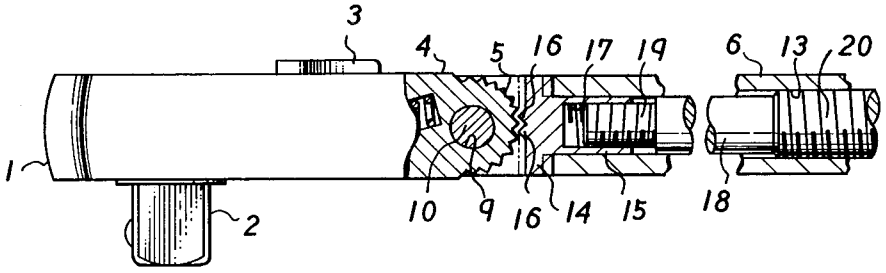
Figure 6:
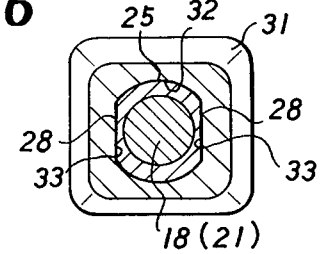
Figure 7:
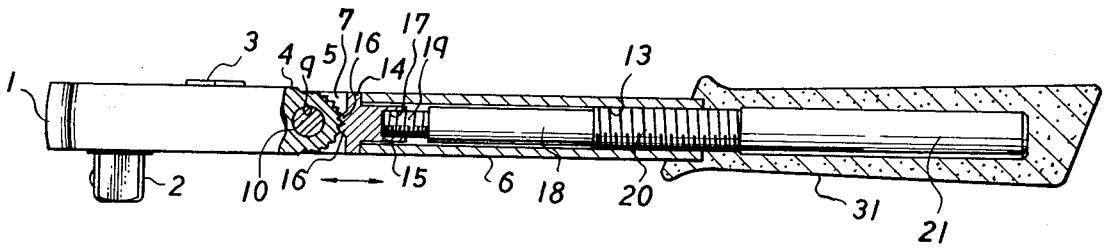
FIG. 7 and FIG. 8 are illustrations showing another embodiment of the present invention.
Figure 8:
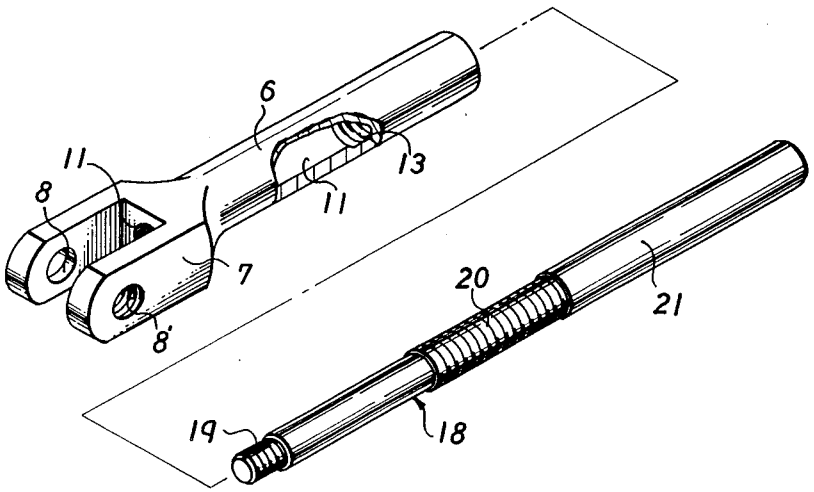

FIG. 3 shows the internal mechanism in which the head and handle are enmeshed at the engagement-/disengagement parts 5 and 16. FIG. 4 shows operational state in which the grip 31 is pulled backward; and the head and handle can be completely disengaged at the engagement/disengagement parts 5 and 16 when the grip 31 is turned a half turn. The above-mentioned relationships are clearly shown in FIG. 5.

With the foregoing construction and functions of the embodiment according to the present invention, no slippage of balls and pins pressed to the periphery of the rotating head is not caused when holding the grip and moving it with a full power in clockwise or counterclockwise direction in order to turn an object with which the head is engaged; and smooth and positive handling of the handle can be achieved at a desired angle between head and handle. Moreover, the head and handle can be easily engaged and disengaged to allow quick selection of an inclined angle of the head. Since the head and handle can be engaged securely and positively, there is no fear of looseness during handling this ratchet handle caused by turning of the threads in opposite directions. The use of a ratchet handle, will be further improved, thus providing significant advantages.

It is clear that various variations of construction can be conceived by minor changes in design according to the present invention.

I claim:

1. A ratchet handle comprising a head, a handle connected to said head by a pin, an operation rod having inner, central and outer portions, said operation rod having said inner and central portions located within said handle, said operation rod having first threads on said inner portion and second threads on said central portion, a moving part having threads engaging said first threads on said operation rod, said handle having threads in engagement with said second threads on said operation rod, means for providing a locking engagement between said moving part and said head, said first and second threads being formed in opposite directions, and a grip enclosing said outer portion of said operation rod.

2. A ratchet handle as in claim 1, wherein a cylinder having front and rear ends is positioned between said grip and said outer portion of said operation rod.

3. A ratchet handle as in claim 1, wherein said locking engagement means includes teeth on said moving part and on said head.

4. A ratchet handle as in claim 2, wherein a pair of recesses are provided at one end of said handle and a pair of projections are provided on said front end of said cylinder, said recesses and projections being engagable with each other.

5. A ratchet handle as in claim 4, wherein a pair of recesses are provided at said rear end of said cylinder, a spring having front and rear ends is mounted on said operation rod at said outer portion thereof, and said spring rear end is retained in place by a block secured to said operation rod.

6. A ratchet handle as in claim 5, wherein a pin passes through said operation rod and said block with the ends of said pin protruding from said block.

* * * * *